US006065958A

United States Patent [19]

Adams et al.

[11] Patent Number: 6,065,958

[45] Date of Patent: May 23, 2000

[54] UTILITY LIGHTER

[75] Inventors: Paul Adams, Monroe; Floyd B. Fairbanks, Naugatuck; Richard M. Orazietti, Derby; Brian Tubby, Milford; Thomas G. Vailionis, Watertown, all of Conn.; James M. McDonough, East Greenwich, R.I.

[73] Assignee: BIC Corporation, Milford, Conn.

[21] Appl. No.: 09/259,288

[22] Filed: Mar. 1, 1999

Related U.S. Application Data

[63] Continuation-in-part of application No. 08/787,399, Jan. 22, 1997, Pat. No. 5,934,895, and application No. 08/917,134, Aug. 25, 1997.

[51] Int. Cl.[7] ..... F23Q 2/28

[52] U.S. Cl. ..... 431/153; 431/255; 361/260

[58] Field of Search ..... 431/153, 255, 431/256, 266, 344; 200/43.01; 361/253, 260

[56] References Cited

U.S. PATENT DOCUMENTS

| | | | |
|---|---|---|---|
| D. 337,839 | 7/1993 | Zeller | D26/43 |
| D. 345,489 | 3/1994 | Moh | D7/416 |
| D. 362,313 | 9/1995 | Zeller | D26/43 |
| 3,520,647 | 7/1970 | Poppel | 431/254 |
| 3,580,698 | 5/1971 | Goto | 431/255 |
| 3,894,273 | 7/1975 | Newport, Jr. et al. . | |
| 3,904,350 | 9/1975 | Goble | 431/256 |

(List continued on next page.)

FOREIGN PATENT DOCUMENTS

| | | |
|---|---|---|
| 0 732 545 A1 | 9/1996 | European Pat. Off. . |
| 54-36882 | 8/1977 | Japan . |
| 54-159069 | 5/1978 | Japan . |
| 61-143620 | 1/1986 | Japan . |
| 64-10027 | 1/1989 | Japan . |
| 2036387 | 5/1995 | Russian Federation . |
| WO 92/08931 | 5/1992 | WIPO . |
| WO 98/31774 | 7/1998 | WIPO . |

OTHER PUBLICATIONS

Supermatch FLX Operating Instructions and Warranty for Model 10504, Zelco Products, 2 pages, Copyright 1994.

*Primary Examiner*—Carl D. Price
*Assistant Examiner*—Sara Clarke
*Attorney, Agent, or Firm*—Pennie & Edmonds LLP

[57] ABSTRACT

The present invention relates to a utility lighter including a housing having a handle at one end and a nozzle with an outlet at another end and including a fuel supply connected for selective fluid communication with the nozzle. An electric ignitor assembly, such as a piezoelectric mechanism, has first and second electrical contacts operatively connected to a first electrical pathway. The first electrical pathway includes a first gap proximate the outlet. An ignition preventing assembly forming a second electrical pathway is also operatively connected to the electric ignitor assembly and has operative and inoperative configurations. In the inoperative configuration, the resistance of the second electrical pathway is less than the resistance of the first electrical pathway such that electrical current generated by the electric ignitor assembly selectively travels in the second electrical pathway. In the operative configuration, the resistance of the second electrical pathway is greater than the resistance of the first electrical pathway such that the electrical current selectively travels in the first electrical pathway and jumps across the first gap to form a spark to ignite fuel from the fuel supply. The second electrical pathway can be a continuous pathway to short circuit the electrical ignitor assembly in the inoperative condition. The second electrical pathway can also include a gap smaller than the first gap so that the spark is formed across this gap rather than the first gap in the inoperative condition. The ignition preventing assembly can be coupled with various mechanical mechanisms for preventing unwanted actuation.

38 Claims, 13 Drawing Sheets

U.S. PATENT DOCUMENTS

| | | | |
|---|---|---|---|
| 3,947,731 | 3/1976 | Vainer | 317/81 |
| 4,069,006 | 1/1978 | Jackson | 431/344 |
| 4,220,443 | 9/1980 | Bear | 431/91 |
| 4,253,818 | 3/1981 | Ogawa et al. | 431/142 |
| 4,253,820 | 3/1981 | Jarreau | 431/344 |
| 4,259,059 | 3/1981 | Roosa et al. | 431/254 |
| 4,273,528 | 6/1981 | Göbelt | 431/255 |
| 4,288,209 | 9/1981 | Yoshinaga | 431/255 |
| 4,292,021 | 9/1981 | Miyagawa | 431/13 |
| 4,389,187 | 6/1983 | Sims | 431/277 |
| 4,403,946 | 9/1983 | Kagawa | 431/255 |
| 4,462,791 | 7/1984 | Hayden | 431/345 |
| 4,516,933 | 5/1985 | Buzzi | 431/255 |
| 4,538,983 | 9/1985 | Zeller et al. | 431/255 |
| 4,569,654 | 2/1986 | Borghesi | 431/255 |
| 4,610,624 | 9/1986 | Bruhn | 431/255 |
| 4,635,382 | 1/1987 | Bourdeau | 34/97 |
| 4,691,691 | 9/1987 | Patenaude | 126/414 |
| 4,699,123 | 10/1987 | Zaborowski | 126/409 |
| 4,778,380 | 10/1988 | Nitta | 431/255 |
| 4,854,859 | 8/1989 | Lin | 431/344 |
| 4,919,111 | 4/1990 | Ohsawa | 126/25 B |
| 5,059,852 | 10/1991 | Meury | 310/339 |
| 5,092,764 | 3/1992 | McDonough et al. | 431/277 |
| 5,135,388 | 8/1992 | Pettit | 431/254 |
| 5,154,483 | 10/1992 | Zeller | 362/198 |
| 5,154,601 | 10/1992 | Capilla | 431/255 |
| 5,199,865 | 4/1993 | Liang | 431/255 |
| 5,222,889 | 6/1993 | Hsu | 431/255 |
| 5,262,697 | 11/1993 | Meury | 310/339 |
| 5,284,439 | 2/1994 | Shike et al. | 431/263 |
| 5,322,433 | 6/1994 | Shike et al. | 431/266 |
| 5,326,256 | 7/1994 | Shike et al. | 431/255 |
| 5,348,467 | 9/1994 | Piffath et al. | 431/153 |
| 5,369,556 | 11/1994 | Zeller | 362/198 |
| 5,412,179 | 5/1995 | Chen | 219/262 |
| 5,417,571 | 5/1995 | Kvalseth | 431/153 |
| 5,427,522 | 6/1995 | McDonough et al. | 431/153 |
| 5,460,521 | 10/1995 | Tsai | 431/255 |
| 5,478,232 | 12/1995 | Dillinger et al. | 431/255 |
| 5,496,169 | 3/1996 | Chen | 431/153 |
| 5,505,614 | 4/1996 | Lin | 431/143 |
| 5,531,592 | 7/1996 | Tsai | 431/255 |
| 5,545,035 | 8/1996 | Tsai | 431/255 |
| 5,564,918 | 10/1996 | Lin | 431/255 |
| 5,564,919 | 10/1996 | Tsai | 431/255 |
| 5,616,022 | 4/1997 | Moran, IV | 431/253 |
| 5,655,901 | 8/1997 | Makoto | 431/153 |
| 5,662,466 | 9/1997 | Cheng | 431/153 |
| 5,697,775 | 12/1997 | Saito et al. | 431/153 |
| 5,704,776 | 1/1998 | Sher | 431/153 |
| 5,738,507 | 4/1998 | Mifune et al. | 431/344 |
| 5,772,423 | 6/1998 | Mandir | 431/254 |
| 5,865,614 | 2/1999 | Hsu | 431/255 |
| 5,885,069 | 3/1999 | Rogelet | 431/153 |
| 5,897,308 | 4/1999 | Saito et al. | 431/153 |
| 5,934,895 | 1/2000 | McDonough et al. | 431/255 |
| 6,012,916 | 1/2000 | Liang | 431/153 |

UTILITY LIGHTER

CROSS-REFERENCE TO RELATED APPLICATIONS

This is a continuation-in-part of application Ser. No. 08/787,399, filed Jan. 22, 1997, U.S. Pat. No. 5,934,895, and application Ser. No. 08/917,134, filed Aug. 25, 1997.

TECHNICAL FIELD

The present invention generally relates to general purpose utility lighters such as those used to ignite candles, barbecue grills, fireplaces and campfires.

BACKGROUND OF THE INVENTION

Lighters such as those used for igniting tobacco products, such as cigars, cigarettes, and pipes, have developed over a number of years. Typically, these lighters use either a rotary friction element or a piezoelectric element to generate a spark in proximity to a nozzle emitting fuel from a fuel container. Piezoelectric mechanisms have gained universal acceptance. One such piezoelectric mechanism is disclosed in U.S. Pat. No. 5,262,697 ("the '697 patent"). The disclosure of the '697 patent is incorporated by reference herein.

Lighters have also evolved from the small, hand-held lighters to several forms of extended lighters. These lighters are also hand held, but are more useful for general purposes such as lighting candles, barbecue grills, fireplaces and campfires. Earlier attempts at such designs relied simply on extended actuating handles to house a typical lighter at the end. Examples of this concept are found in U.S. Pat. Nos. 4,259,059 and 4,462,791.

In addition, many utility lighters have had some form of operating mechanism to prevent unintentional operation of the lighter by adults. Often, these mechanisms take the form of on/off switches that may prevent actuation of the lighter. However, the on/off switches must be positively moved by the user between the "on" and "off" positions, and as a result have drawbacks. For example, an adult user may forget to move the switch back to the "off" position after use and thereby render the feature ineffective.

Published PCT application WO 92/08931 discloses a safety device for a gas lighter having a piezoelectric mechanism. The safety device includes a switch, which when moved to a first position allows the spark generated by the piezoelectric mechanism to be discharged at a location remote from the released gas. Thus, ignition of the gas is prevented. When the switch is moved to a second position, the spark is discharged at a location sufficiently proximal to the gas flow to allow ignition of the released gas, and hence normal operation of the lighter. The safety mechanism disclosed in WO 92/08931 suffers from the same drawbacks as other on/off switches.

Published PCT application WO 98/31774 ("the '774 publication") and the two related U.S. patent applications, U.S. Ser. No. 08/787,399 filed Jan. 22, 1997, U.S. Pat. No. 5,934,895, ("the '399 application") and U.S. Ser. No. 08/917,134 filed Aug. 25, 1997 ("the '134 application"), all disclose a utility lighter. The disclosures of the '399 application and the '134 application are incorporated by reference herein. In one embodiment, the utility lighter has a valve actuator for releasing fuel and a piezoelectric mechanism for generating a spark proximal to a nozzle. An actuating assembly facilitates depression of the valve actuator and activation of the piezoelectric mechanism. A latch member normally locks the actuating assembly in an inoperative position. The latch member functions by mechanically preventing the actuating assembly from releasing the fuel gas in combination with compressing the piezoelectric mechanism to prevent the generation of a spark. Even though the mechanical blocking means disclosed in the '774 publication satisfactorily resists unwanted actuation, it may be desirable to have an electrical blocking mechanism to resist unwanted actuation.

Thus, there remains a need for a utility lighter which resists unwanted actuation by electrical blocking means, either alone or in combination with mechanical blocking means.

SUMMARY OF THE INVENTION

These objects and advantages as well as other objects and advantages are accomplished in a lighter generally including a housing having a nozzle with an outlet and a fuel supply connected for selective fluid communication with the nozzle. An electric ignitor assembly having first and second electrical contacts is operatively connected to a first electrical pathway. The first electrical pathway includes a first gap located proximal to the nozzle outlet. A second electrical pathway is also operatively connected to the electric ignitor assembly. The second electrical pathway has operative and inoperative configurations.

In the inoperative configuration, the resistance of the second electrical pathway is less than the resistance of the first electrical pathway such that electrical current generated by the electric ignitor assembly selectively travels in the second electrical pathway. In the operative configuration, the resistance of the second electrical pathway is greater than the resistance of the first electrical pathway such that said electrical current selectively travels in the first electrical pathway and jumps across the first gap to form a spark to ignite fuel selectively released from the fuel supply.

In the inoperative configuration, the second electrical pathway may be a continuous pathway to short circuit the electric ignitor assembly. The second electrical pathway may also include a second gap that is smaller than the first gap in the inoperative configuration, such that the resistance of the second pathway remains less than that of the first pathway. In the operative configuration, the second electrical pathway and the second gap is larger than the first gap. Preferably, the second gap is at least approximately twice as large as the first gap in the operative configuration.

In one embodiment, the lighter has a pushbutton for switching the second electrical pathway from the inoperative configuration to the operative configuration. The pushbutton is operatively associated with a resilient member, such as a spring. When the pushbutton is depressed, the second gap, which is larger than the spark gap, is formed. If the resilient member is made of an electrically conductive material, the resilient member may be part of the second electrical pathway.

The lighter may include an actuating assembly operatively connected to the housing to dispense fuel from the fuel supply and to activate the electric ignitor assembly. The lighter may also include a latch member, which is operatively connected with the handle and includes a blocking portion connected for biased movement relative to the actuating assembly. This blocking portion is normally biased into engagement with the actuating assembly to prevent operative movement thereof. Thus, a user may selectively bias the blocking portion out of engagement with the actuating assembly to permit operation of the actuating assembly, such as through the use of a trigger extending from the handle.

In another aspect of this invention, the blocking portion engages part of the actuating assembly only when the switching member is between the first and second positions.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION

Figure 1:
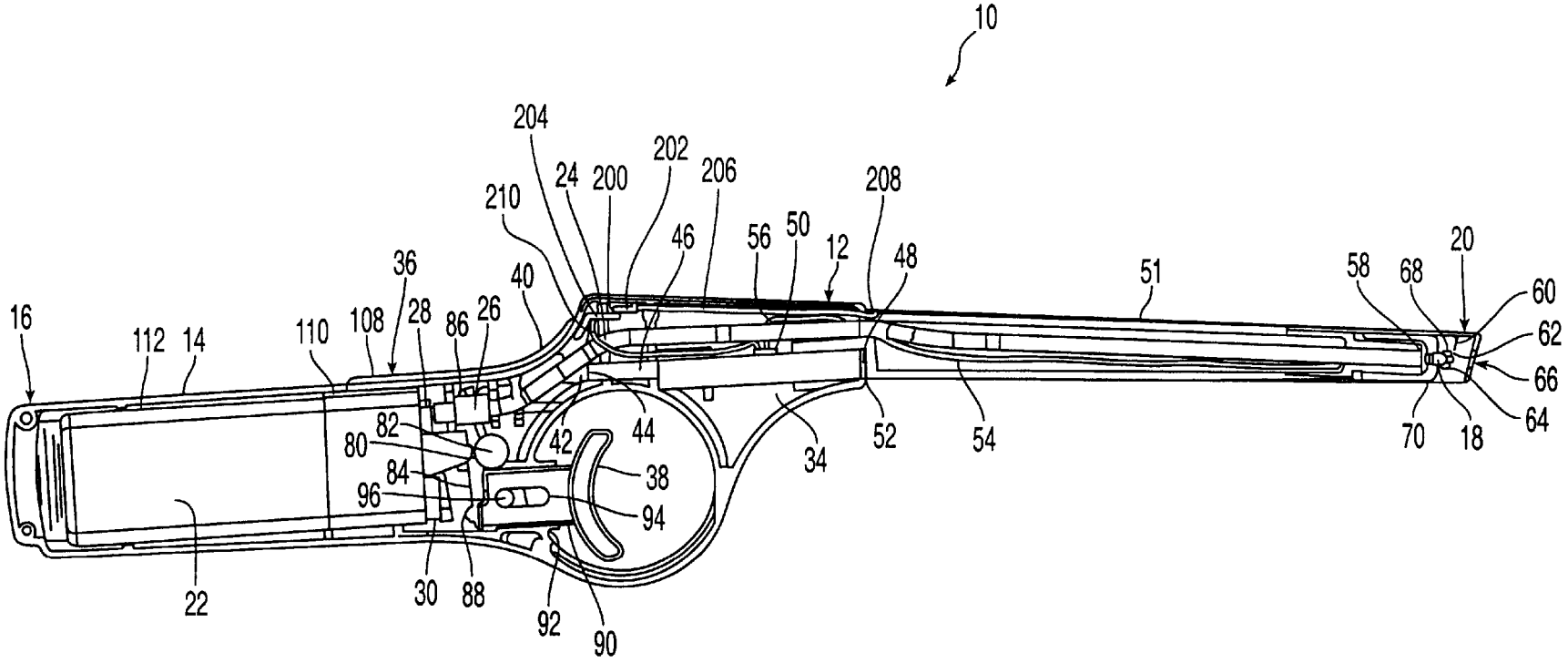
FIG. 1 is a side elevational view of the utility lighter of this invention in partial cross-section showing various inner elements thereof.

Turning to FIG. 1, a preferred embodiment of a utility lighter 10 constructed in accordance with the present invention is shown with the understanding that those of ordinary skill in the art will recognize that many modifications and substitutions may be made to various elements.

Lighter 10 generally includes a housing 12 which may primarily be formed of a molded rigid polymer or plastic materials such as acrylonitrile butadiene styrene terpolymer (ABS) or the like. Housing 12 includes a handle 14 proximate to a first end 16. A nozzle 18 is disposed at a second end 20 for emitting fuel to feed a flame as will be described herein. It will be noted that the terms, first end 16 and second end 20, are used for convenience only and form no part of the invention. Handle 14 preferably contains a fuel supply container 22, which may be a conventional butane fuel cell. A conduit 24, such as a plastic tube, is fixed to a fluid connector 26 and then positioned next or connected to a valve 28 on fuel supply container 22. The opposite end of tube 24 connects to nozzle 18. It will also be noted that a lighter not having its own fuel supply container, e.g., a device which generates a spark or series of sparks to ignite an external fuel source, is also contemplated by the present invention.

Valve 28 is operated by a valve actuator 30, which is pivotally attached to fuel supply container 22. When valve actuator 30 is depressed, e.g., moved toward end 16, fuel is released by valve 28, and flows through connector 26 and tube 24, and finally to nozzle 18. A suitable fuel supply container 22 is disclosed in U.S. Pat. No. 5,520,197 ("the '197 patent"). The disclosure of the '197 patent is incorporated herein by reference.

An actuating assembly is provided to facilitate depression of the valve actuator and to activate an electric ignitor assembly 34 for generating a spark proximate nozzle 18. Actuating assembly preferably comprises a trigger member 38, a biased pivoting member 80, and a linking rod 46 operatively connected to the ignitor assembly 34. These components arc described in detail below. Trigger member 38 can be replaced with a squeeze mechanism such that when pressure is applied to handle 14 in a specific direction, one handle part pivots with respect to another to activate the ignitor assembly 34. Additionally, a number of different electric ignitor assemblies such as battery or solar powered electrical circuits are contemplated by the present invention. Although not necessary for all aspects of this invention, a piezoelectric mechanism is the preferred electric ignitor assembly 34. More specifically, the preferred piezoelectric mechanism is of the type disclosed in the '697 patent, the disclosure of which has been incorporated herein by reference.

Figure 2:
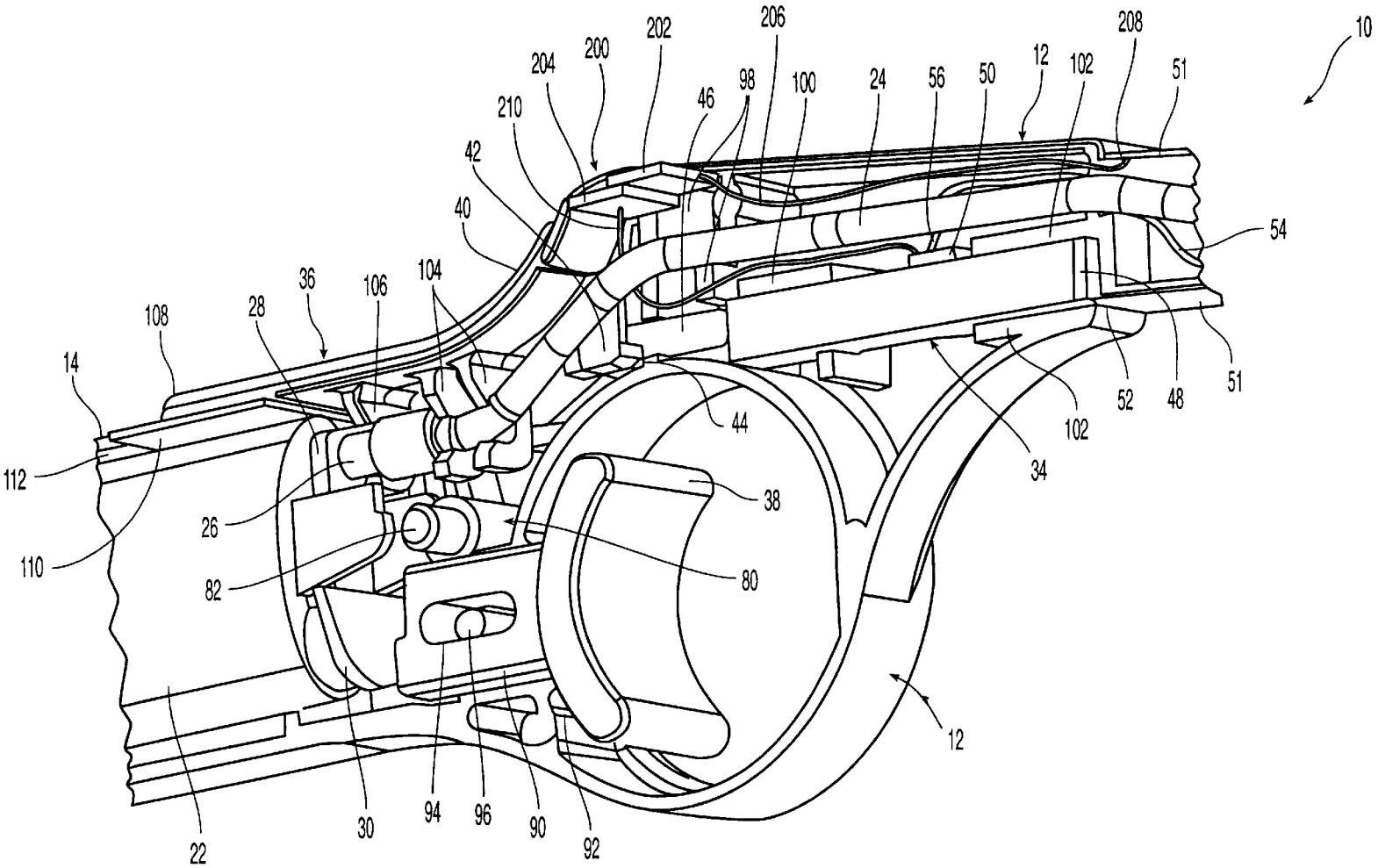
FIG. 2 is an enlarged and partially fragmented perspective view of the lighter shown in FIG. 1.
Figure 3:
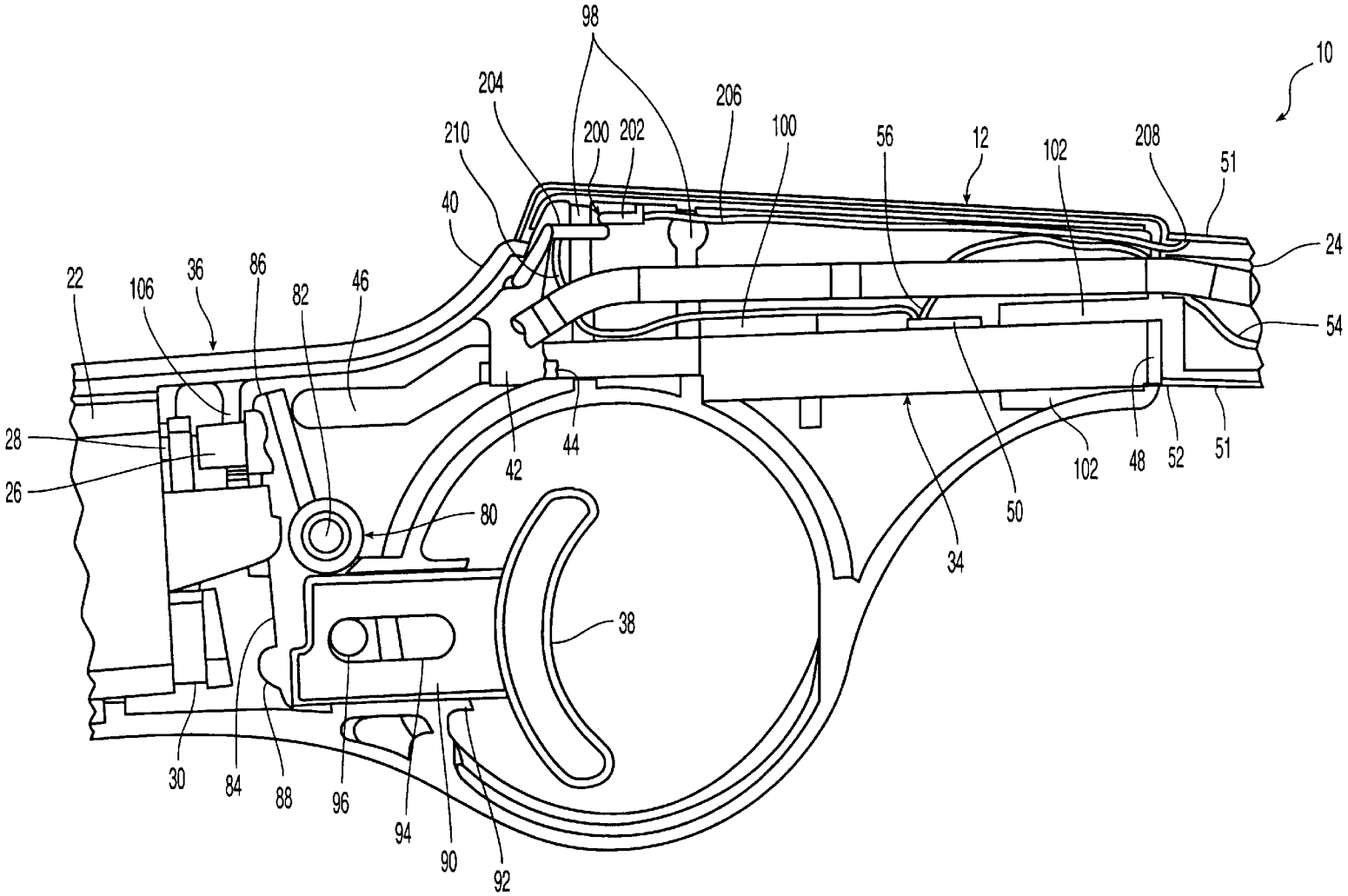
FIG. 3 is an enlarged and partially fragmented side elevational view similar to FIG. 1 with certain portions omitted to show more clearly the ignition preventing assembly, the actuating assembly and the latch member.

Piezoelectric mechanism 34 has been illustrated in FIGS. 1–3 schematically and particularly described in the '697 patent. The details necessary for an understanding of this invention have been shown in the drawings. In summary, however, piezoelectric mechanism 34 is a telescopic assembly which may be compressed to generate a voltage between first and second electrical contacts 48, 50. Specifically, piezoelectric mechanism 34 contains a piezoelectric crystal in electrical contact with and generally situated between electrical contacts 48, 50. Electrical contact 48 is generally referred to as an anvil and electrical contact 50 contacts an impact pad positioned on an opposite side of the piezoelectric crystal. First electrical contact or anvil 48 is in direct contact with an electrically conductive wand 51, which is disposed on the outside of a portion of housing 12 at junction location 52, as best illustrated in FIG. 3.

Conductive wand 51 is preferably made out of metal. Second electrical contact 50 is connected to an insulated wire 54 having two exposed ends 56, 58. Exposed end 56 is connected to contact 50 while exposed end 58 is connected to nozzle 18. Nozzle 18 may also include a diffuser spring, which is essentially an electrically conductive coil spring, where the space between the adjacent coils of the spring is designed to allow air to mix with the released fuel to ensure a proper air/fuel mixture suitable for combustion. Nozzle 18 therefore acts as a first electrode and is preferably formed of an electrically conductive metal such as brass or zinc for this purpose. As used herein, the term electrode includes a terminal point in an electrical pathway.

Conductive wand 51 is electrically connected to contact 48 at junction 52. At the opposite end, a tab or antenna 60 is stamped from wand 51 proximate end 20 to act as a second electrode and create a spark gap 62 with an outlet 64 of nozzle 18. The first electrode (nozzle 18 or the diffuser spring), wire 54, piezoelectric mechanism 34, wand 51, and the second electrode (tab or antenna 60) form a first electrical pathway. An opening 66 at the end of conductive wand 51 allows the passage of fuel from the lighter. Also, in a conventional manner, side apertures 68, only one of which is shown in FIG. 1, may be provided to allow the intake of air.

An electrically insulating cap 70 is preferably disposed around at least a portion of nozzle 18 and generally between nozzle 18 and conductive wand 51. This electrically insulating cap 70 deters sparks from being generated between nozzle 18 and any surfaces of conductive wand 51 other than the tab 60.

Referring to FIGS. 1–3, a first embodiment of an ignition preventing assembly 200 according to the present invention comprises a second electrical pathway operatively connected to piezoelectric mechanism 34. The second electrical pathway includes a third electrode 202 and a fourth electrode 204. Third electrode 202, which can be attached to housing 12, is connected to a first end of wire 206. A second end of wire 206 is attached to electrically conductive wand 51 at a junction location 208. As previously described, electrical contact 48 is in direct contact with electrically conductive wand 51 at junction location 52. Thus, third electrode 202 is electrically coupled to electrical contact 48.

Fourth electrode 204 is attached to a latch member 36 at unsupported resilient front end 40 and is connected to a first end of a wire 210. A second end of wire 210 is attached to electrical contact 50. Thus, third and fourth electrodes 202, 204 are both electrically coupled to piezoelectric mechanism 34. In the first embodiment, third and fourth electrodes 202, 204, wires, 206, 210, and wand 51 form the second electrical pathway for the electrical energy released by activation of piezoelectric mechanism 34. When third and fourth electrodes 202, 204 are in contact or close to being in contact, as would be the case when latch member 36 is not depressed, the second electrical pathway either short circuits piezoelectric mechanism 34 or the effective resistance of the second electrical pathway is significantly less than that of the first electrical pathway, so that any electrical energy generated by the activation of piezoelectric mechanism 34 selectively flows away from the first electrical pathway.

Figure 5:
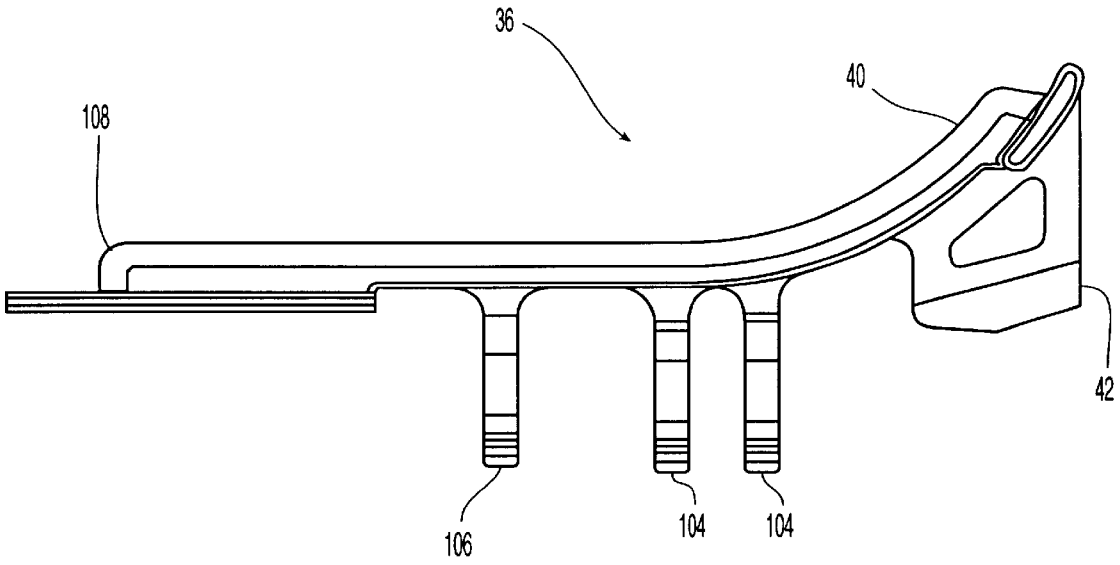
FIG. 5 is a side view of a latch member.

FIGS. 2 and 5 best illustrate the construction and connection of latch member 36 to housing 12. It has been found that latch member 36 may be formed of a polymer that exhibits resiliency or flexure during operation. One such polymer for example is polyacetal. Although other constructions may also be used incorporating other types of resilient members or springs, one design of the construction is a resilient member fixed with a cantilevered connection at one end 108 to handle 14. Specifically, a flange portion 110 fixed to end 108 of latch member 36 is contained within a slot 112 in handle 14. Front end 40 of latch member 36 remains unconnected to housing 12 and may be resiliently depressed downwardly to electrically uncouple third and fourth electrodes 202, 204. As front end 40 is depressed, a second gap 205 between third and fourth electrodes 202, 204 either begins to form or to grow. When the second gap 205 is sufficiently large, electrical energy released by piezoelectric mechanism 34 will selectively travel through the first electrical pathway and a spark will be created at spark gap 62. Preferably, the second gap 205 is approximately twice as large as spark gap 62 or more, when latch member 36 is fully depressed to ensure that the spark occurs at or near spark gap 62.

Figure 4A:
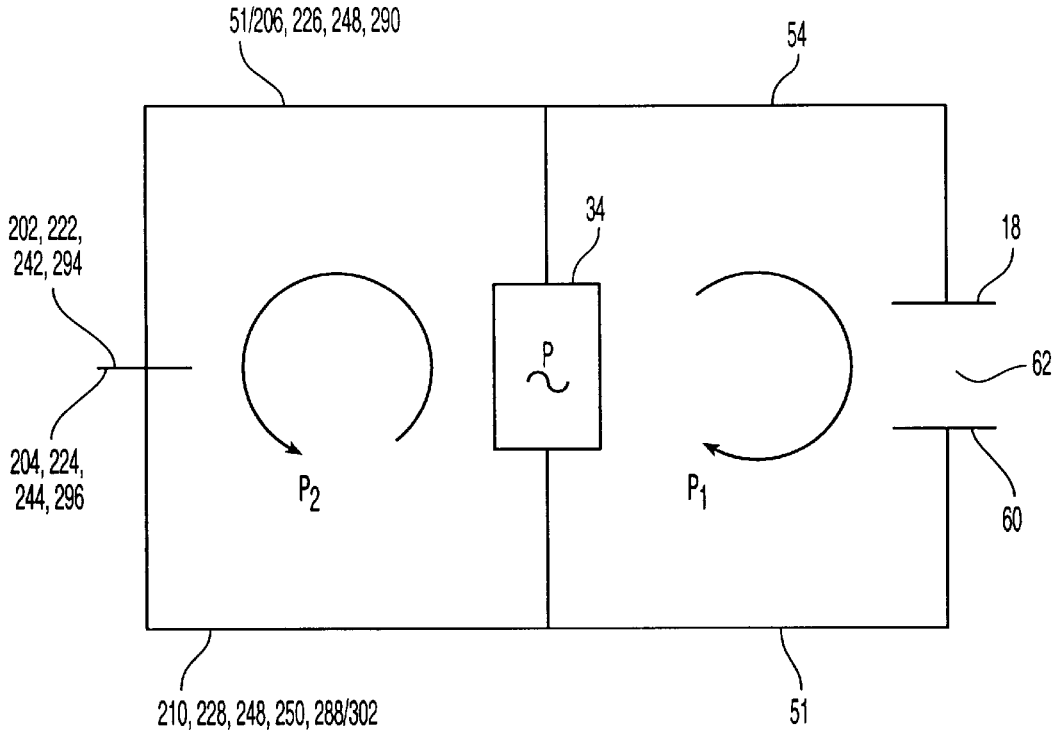
FIG. 4A is a schematic drawing of the ignition preventing assembly showing the first and second electrical pathways with the second electrical pathway as a short circuit.
Figure 4B:
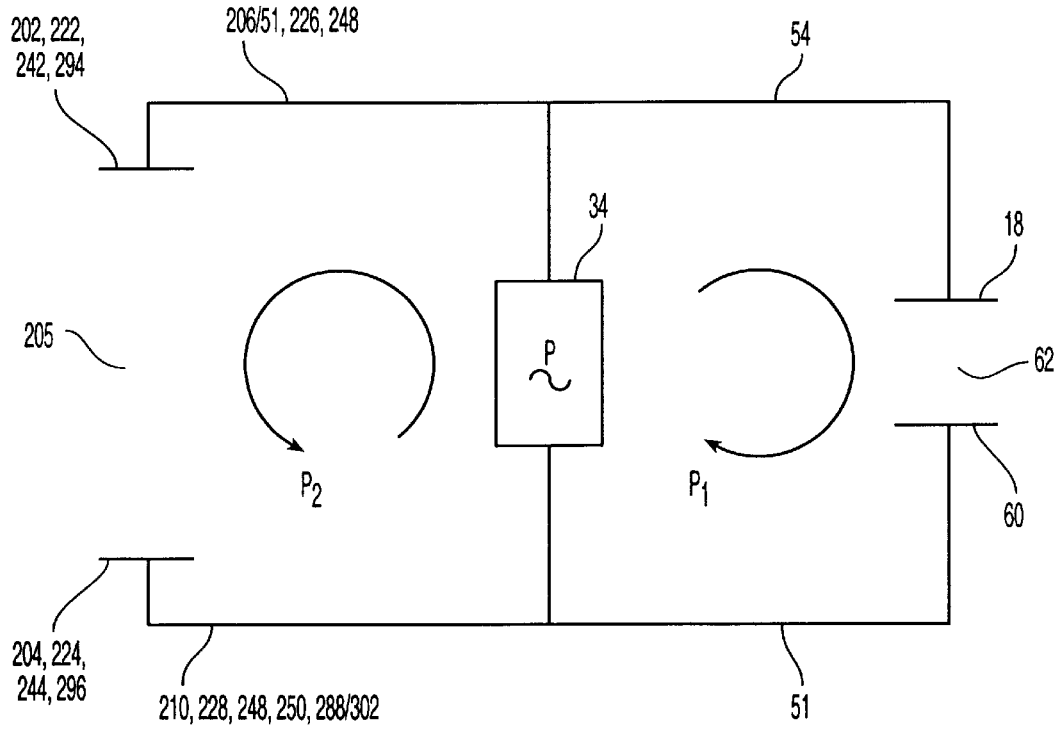
FIG. 4B is a schematic drawing of the ignition preventing assembly showing the first and second electrical pathways with the second electrical pathway having a gap.

FIGS. 4A and 4B show schematically an ignition preventing assembly according to the present invention. P represents piezoelectric mechanism 34 and $P_1$ represents the first electrical pathway. As previously discussed, first electrical pathway includes nozzle 18 acting as the first electrode and tab 60 acting as the second electrode defining spark gap 62 therebetween. The first electrical pathway has an effective resistance $R_1$. The second electrical pathway, discussed above, is represented by $P_2$ and has an effective resistance of $R_2$. When the third and fourth electrodes 202, 204 are in contact or close to being in contact, $R_2$ is very small compared to $R_1$, and the second electrical pathway becomes a short circuit or effectively a short circuit. Any current generated by the actuation of the piezoelectric mechanism 34 will selectively flow through the second electrical pathway. This diverts the electrical current away from first electrical pathway $P_1$, and prevents the generation of a spark in spark gap 62, thereby preventing ignition of released fuel. When second gap 205 is formed between electrodes 202 and 204, if the width of gap 205 is less than the width of spark gap 62, second gap 205 has less resistance than spark gap 62 for a spark to jump across. Thus, any current created by the actuation of piezoelectric mechanism 34 selectively creates a spark across second gap 205, and prevents ignition of released fuel. However, when second gap 205 is larger than spark gap 62, second gap 205 has more resistance than spark gap 62. Thus, any current created by the actuation of piezoelectric element 34 selectively travels in the first electrical pathway, and creates a spark across spark gap 62 to ignite the released fuel.

In summary, in the second electrical pathway, there are three possible configurations of the third and fourth electrodes 202, 204. In the first configuration, third and fourth electrodes 202, 204 are electrically coupled and the second electrical pathway forms a short circuit for any electrical energy released by piezoelectric mechanism 34. It is important to note that as front end 40 is resilient, third and fourth electrodes 202, 204 are normally biased to be electrically coupled or close to being coupled. In the second configuration, latch 36 has been partially depressed so that third and fourth electrodes 202, 204 are separated by a second gap 205. However, when this gap is smaller than spark gap 62, electrical current released by piezoelectric mechanism 34 still travels through the second electrical pathway to create a spark between third and second electrodes 202, 204. Because this spark occurs remotely from nozzle 18, the outlet for released fuel, no ignition is obtained. In the third configuration, latch 36 is sufficiently depressed so that second gap 205 is sufficiently larger than spark gap 62, so that electrical current released upon activation of piezoelectric mechanism 34 selectively travels through the first electrical pathway. As a result, a spark is formed across spark gap 62 and ignition of released fuel from nozzle 18 occurs.

Figure 6:
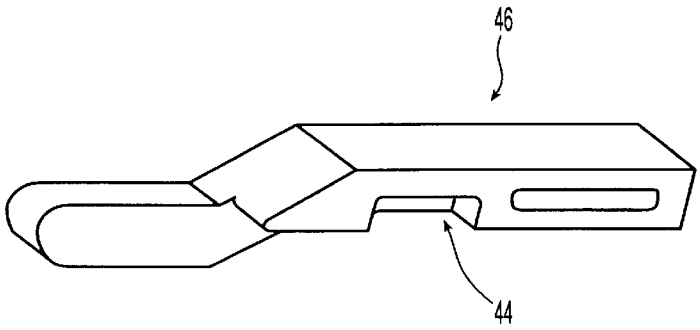
FIG. 6 is a perspective view of a linking rod.

Although ignition preventing assembly 200 adequately resists unwanted activation by itself, it is possible to couple ignition preventing assembly 200 with mechanical blocking means for resisting unwanted activation. An example of such mechanical blocking means coupled with ignition preventing assembly 200 is shown in FIGS. 1–3. Specifically, latch member 36 normally locks the actuating assembly in an inoperative position such that trigger 38 may not be depressed or pulled by a user. Front end 40 of latch member 36 has an attached hooked tab 42 normally in engagement with stop member structure 44 on a linking rod 46, shown particularly in FIG. 6. When hooked tab 42 is engaged against stop member structure 44, which may comprise a recess in linking rod 46, linking rod 46 may not be moved in a forward direction to compress and actuate piezoelectric mechanism 34. Thus, latch member 36 prevents sufficient movement of trigger 38 toward valve actuator 30 so as to prevent the release of electrical energy by piezoelectric mechanism 34.

The operation of lighter 10 may be appreciated further from a review of FIGS. 2 and 3. In addition to trigger 38 and linking rod 46, actuating assembly 32 includes a biased pivoting member 80 operatively connected therebetween. Specifically, pivoting member 80 is mounted to a pin 82 in a biased manner, such as through a torsion spring (not shown) placed between member 80 and pin 82, such that member 80 is biased in a counterclockwise direction as viewed in FIGS. 1 and 3.

Alternatively, pivoting member 80 may be biased by a return spring disposed within the two telescopic members of piezoelectric mechanism 34 to maintain separation between the telescopic members. Said return spring exerts a biasing force on rod 46 which is in physical contact with pivoting member 80. Such a return spring is disclosed in the '697 patent.

Biased pivoting member 80 further includes a pair of arms 84, 86 generally extending from pin 82. Arm 84 may include a knob 88 for depressing valve actuator 30 when the user pulls trigger 38. Alternatively, a portion of trigger 38 itself may be used to directly engage valve actuator 30. Trigger 38 preferably includes an extension 90 containing thereon a channel 92 for sliding movement relative to housing 12. Extension 90 further includes a slot 94 therewithin, which receives a pin 96 rigidly connected or molded with housing 12. In the position shown in FIG. 3, pin 96 acts as a stop against one end of slot 94 to prevent further forward movement of trigger 38. The opposite end of slot 94 may act as a stop in the other direction. Other types of features that limit forward or rearward movements can also be used.

Arm 86 of pivoting member 80 bears against one end of linking rod 46, as also shown in FIG. 3. Linking rod 46 is supported for sliding movement in forward and rearward directions by suitable support members, such as support members 98 molded into housing 12. Further support members are provided within housing 12 for various purposes, such as support members 100, 102 for holding ignitor assembly or piezoelectric mechanism 34 and support members 104, 106 (also shown in FIG. 5) for respectively holding fuel conduit 24 and connector 26.

Lighter 10 can also include a linking mechanism, such as a leaf spring, which is provided to facilitate the presence of fuel at nozzle outlet 64 when the spark is created across spark gap 62. Fuel travels through conduit 24 at a speed which is determined based upon such factors as fuel pressure, the size of conduit 24, and the flow rate of valve 28, among other factors. Thus, it is desirable to consider such factors in designing a linking mechanism which helps to ensure that the fuel reaches nozzle outlet 64 prior to spark generation. The linking mechanism is preferably disposed between the actuating assembly and the valve actuator. When the actuating assembly is moved or depressed inwardly, it acts on the linking mechanism. The linking mechanism, being directly associated with the valve actuator, depresses the valve to release fuel. An example of such a linking mechanism is disclosed in the '134 application.

The operation of lighter 10 will now be described generally with reference to FIG. 1. With one hand, a user grasps handle 14 with the index finger on trigger 38 and the thumb on front end 40 of latch member 36. Depressing and holding down the front end 40 of latch member 36 has two consequences. First, second gap 205 is formed between the third and fourth electrodes 202, 204. Second, hooked tab 42 disengages from linking rod 46 (FIG. 3) and allows full movement of trigger 38. Thereafter, the user can pull trigger 38, which causes the depression of valve actuator 30 thereby releasing fuel from fuel supply container 22 through valve 28, connector 26 and conduit 24. Gaseous fuel, such as butane, is thereby released from nozzle 18 at outlet 64.

At the same time, the actuation of trigger 38 rotates arm 86 of spring biased pivot 80 in a clockwise direction against linking rod 46, as will be best understood from FIG. 3. Linking rod 46 moves forward and compresses piezoelectric mechanism 34 to generate a voltage between electrical contacts 48, 50. Electrical current passes from contact 48 into electrically conductive wand 51 and from contact 50 into either wire 54 or wire 210. Current will flow through wire 210 if the second gap 205 is either zero or smaller than spark gap 62. As a result, a spark will not be generated or will be generated between third and fourth electrodes 202, 204. As this spark is remote from nozzle outlet 64, no ignition of the release fuel results. If latch member 36 has been sufficiently depressed such that the second gap 205 is larger than spark gap 62, current flows through wire 54, which is connected to electrically conductive nozzle 18. A spark is thereby generated in spark gap 62 to ignite the air/gas mixture in the vicinity of nozzle outlet 64. As long as the user sufficiently depresses front end 40 of latch member 36, the trigger may be repeatedly pulled and the piezoelectric mechanism 34 may be actuated repeatedly to generate a spark to ignite the released fuel in the event that the first actuation does not produce a flame.

When the user releases trigger 38, spring biased pivot 80 is biased in a counterclockwise position to disengage valve actuator 30, which is also biased in an outward direction, in order to close valve 28 and shut off the supply of fuel to nozzle 18. When the user releases front end 40 of latch member 36, third and fourth electrodes 202, 204 come back into contact or close to being in contact to prevent generation of a spark at spark gap 62. Additionally, hooked tab 42 re-engages recess or stop member structure 44 on linking rod 46 thus preventing movement of linking rod 46 with respect to ignitor assembly 34 and limiting inward movement of trigger 38. Therefore, as front end 40 of latch member 36 is normally biased in this upward position such that hooked tab 42 engages link member 46, a user cannot inadvertently leave lighter 10 where trigger 38 may simply be pulled to activate the lighter without again depressing latch member 36. Also, the relative difficulty of operating both the latch member and the trigger essentially at the same time further increases the skills required to operate the lighter.

It is again noted that the ignition preventing assembly 200 as described above is sufficient to limit unwanted actuation of utility lighter 10 without the mechanical blocking mechanism.

Figure 7:
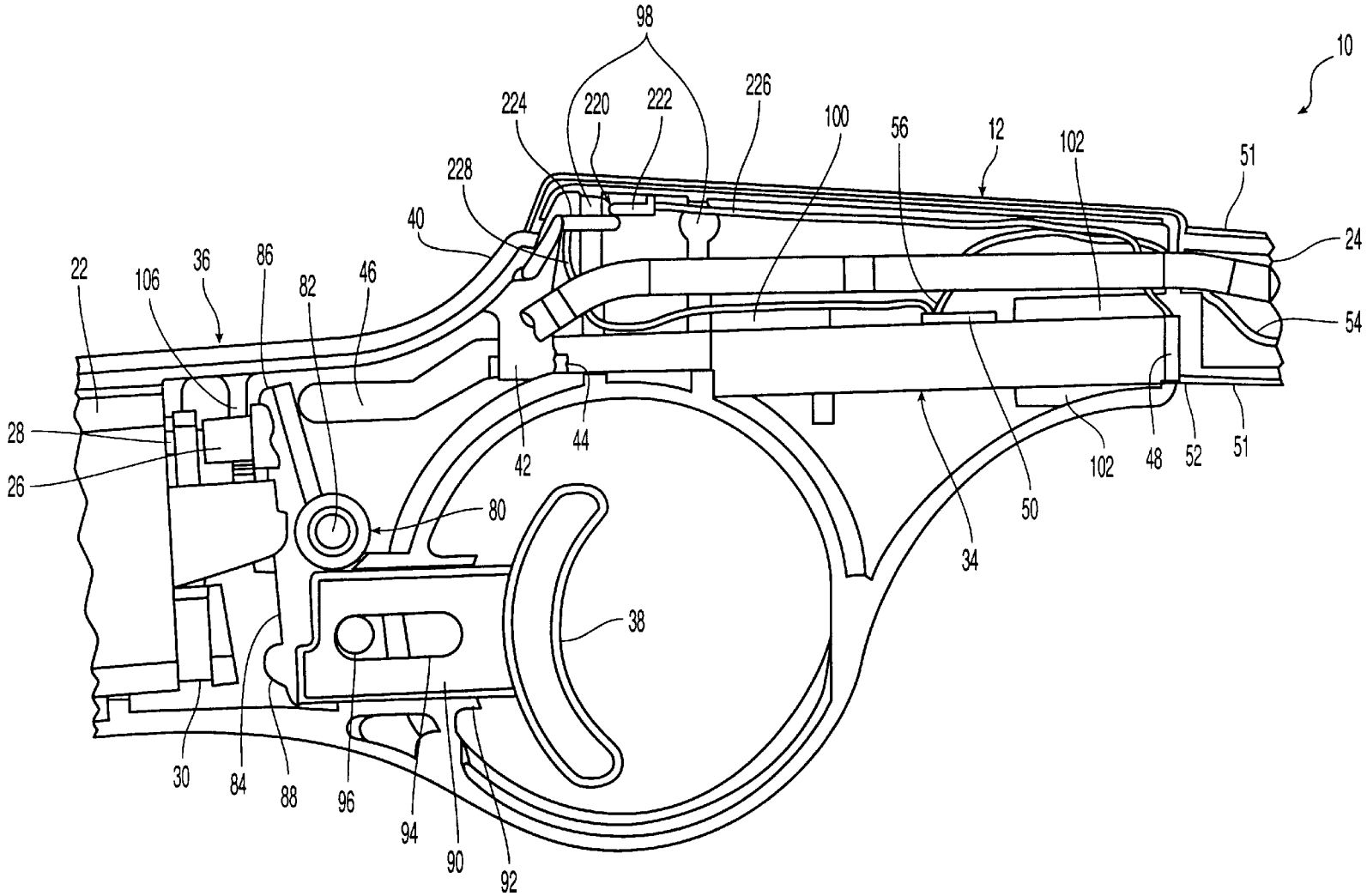
FIG. 7 is an enlarged and partially fragmented side elevational view similar to FIG. 3 showing an alternative embodiment of the ignition preventing assembly.

FIG. 7 shows an alternative embodiment of the ignition preventing assembly according to the present invention. Ignition preventing assembly 220 includes a second electrical pathway with a wire 226 connecting a third electrode 222 to electrical contact 48 and a wire 228 connecting a fourth electrode 224 to electrical contact 50. As is readily apparent from comparing FIG. 3 to FIG. 7, the main difference between ignition preventing assembly 200 and ignition preventing assembly 220 is that in the former, third electrode 202 is connected to anvil 48 via electrically conductive housing 51, and in the later, third electrode 222 is directly connected to anvil 48.

Figure 8:
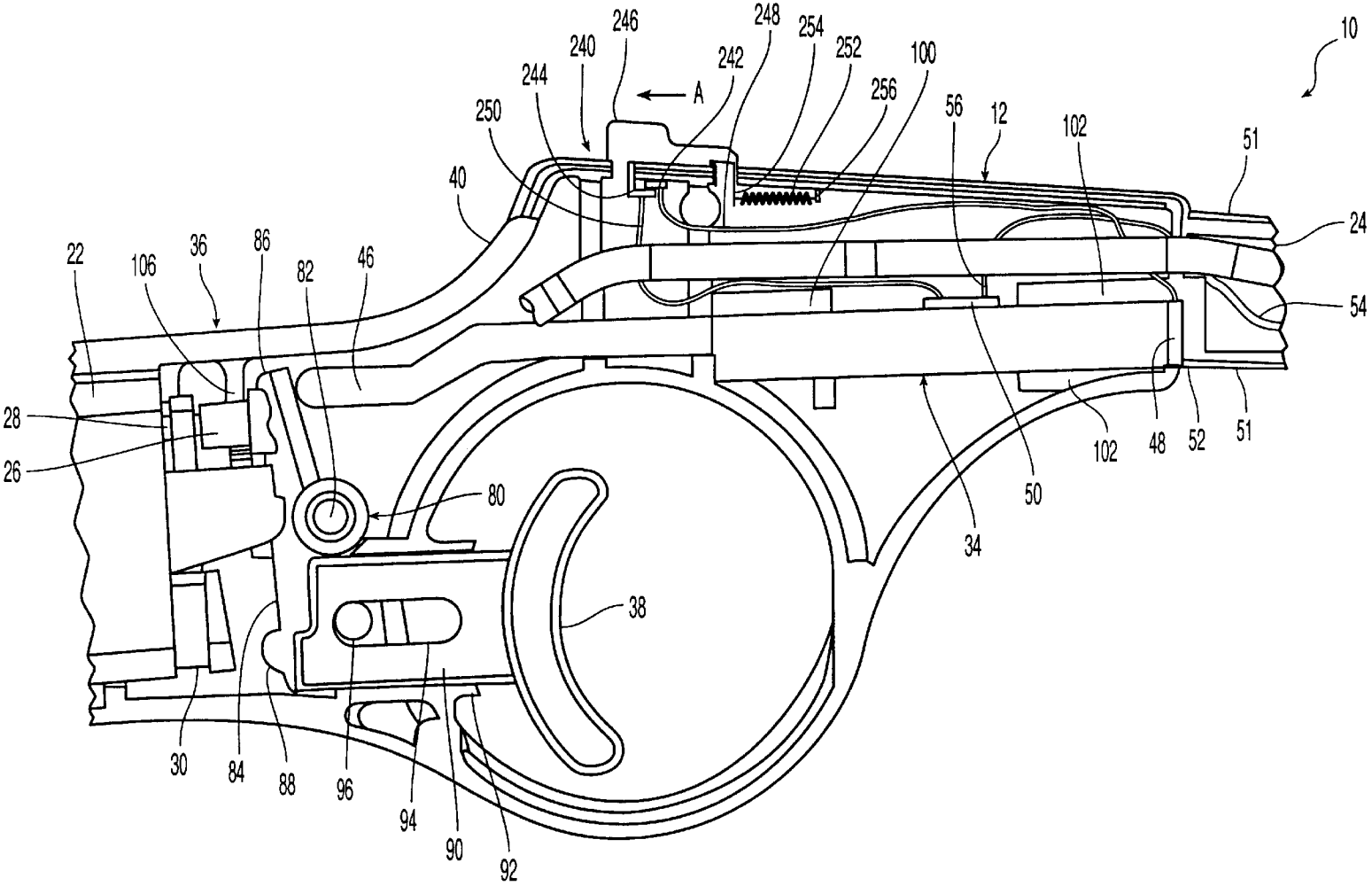
FIG. 8 is an enlarged and partially fragmented side elevational view similar to FIG. 3 showing another embodiment of the ignition preventing assembly.

FIG. 8 shows another embodiment of the ignition preventing assembly according to the present invention. Ignition preventing assembly 240 includes a third electrode 242, a fourth electrode 244, and a slide 246. A wire 248 connects third electrode 242 directly to anvil 48 and a wire 250 connects fourth electrode 244 to electrical contact 50 to form the second electrical pathway. Third electrode 242 can be attached to the underside of slide 246 and fourth electrode 244 can be attached to housing 12. As shown in FIG. 8, third and fourth electrodes 242, 244 are normally in contact with each other or are in close proximity to one another. As a result, the second electrical pathway essentially short circuits piezoelectric mechanism 34 or has significantly lower resistance so that the electrical current generated by piezoelectric mechanism 34 flows through the second electrical pathway to prevent generation of a spark at spark gap 62.

However, slide 246 is slideable along housing 12 in the direction of arrow A to move third and fourth electrodes 242, 244 out of contact and form a second gap 205 therebetween. When second gap 205 is sufficiently larger than the spark gap 62, any electrical current generated by the activation of piezoelectric mechanism 34 flows through the first electrical pathway to generate a spark across spark gap 62. Preferably, second gap 205 is approximately twice as large as spark gap 62 or more for a spark to be generated across spark gap 62. A biasing spring 252 biases slide 246 so that third and fourth electrodes 242, 244 are ordinarily substantially in contact with each other. Biasing spring 252 has one end attached to a post member 254 of slide 246 and another end fixed to housing 12 at a stud 256. It will be noted that slide 246 can be used in lieu of latch 36. Alternatively, it can be used with latch 36, with latch 36 performing the mechanical blocking function. It should be readily apparent from FIG. 8 that ignition preventing assembly 240 can be modified, so that slide 246 can move in the direction other than the direction of arrow A to disconnect third and fourth electrodes 242, 244.

Figure 9A:
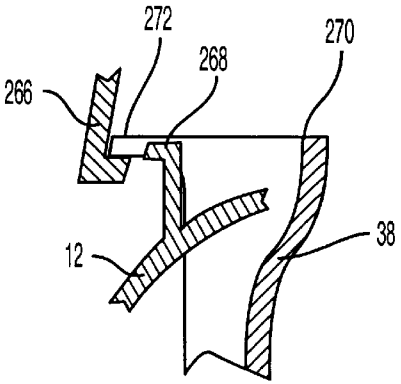
FIG. 9A is an enlarged side elevational view of the circled region of FIG. 9 after the trigger has been activated.
Figure 9B:
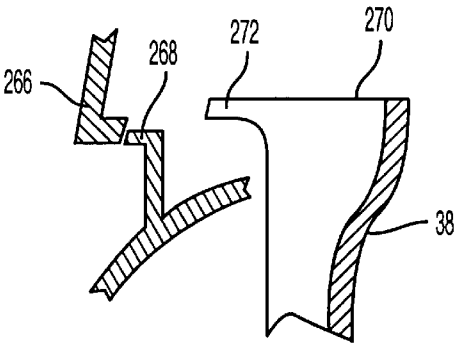
FIG. 9B is an enlarged side elevational view of the circled region of FIG. 9 after the trigger has been released.
Figure 9:
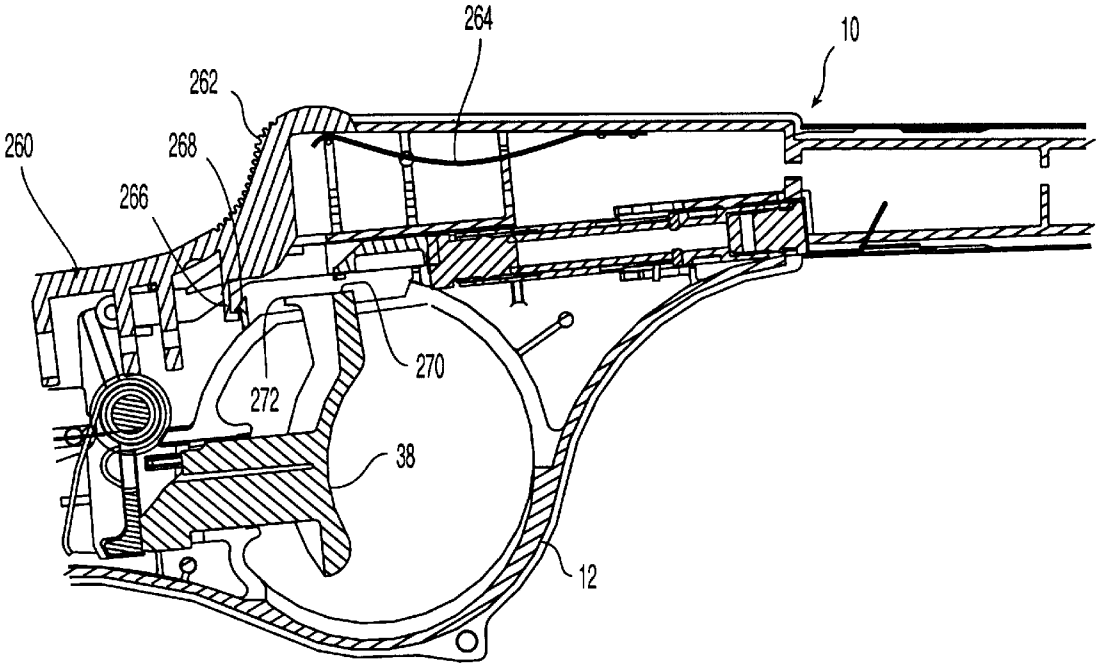
FIG. 9 is a side elevational view of a portion of a utility lighter according to the present invention detailing a different embodiment of a trigger and latch member.

FIG. 9 shows one embodiment of a latch member that does not require continual depression. It should be noted that FIG. 9 is a simplified drawing in which the ignition preventing assembly is omitted. A latch member 260 has a resilient front end 262 which flexes back when depressed. An optional leaf (or coil) spring 264 supports front end 262 and biases front end 262 in an upward position. As front end 262 is depressed, a resilient tab 266 dependent from latch member 260 flexes to engage a hook 268 located on housing 12 to lock latch member 260 in the depressed position. As trigger 38 is pulled back to actuate lighter 10, a top edge 270 with shoulder 272 of trigger 38 disengages tab 266 from hook 268. Tab 266 now engages shoulder 272 of trigger 38 (FIG. 9A) to prevent latch member 260 from returning to the upward position. Note that the flexible nature of tab 266 allows it to bend far enough to accommodate the entire range of movement of trigger 38. Preferably, tab 266 is made from a resilient metal strip. Furthermore, as shoulder 272 is located higher than hook 268, the engagement between shoulder 272 and tab 266 occurs at a higher elevation than the engagement between hook 268 and tab 266 (FIG. 9B). As a result, hook 268 cannot re-engage tab 266 when trigger 38 is released. Thus, latch member 260 returns to the upward position when trigger 38 is released.

Figure 10A:
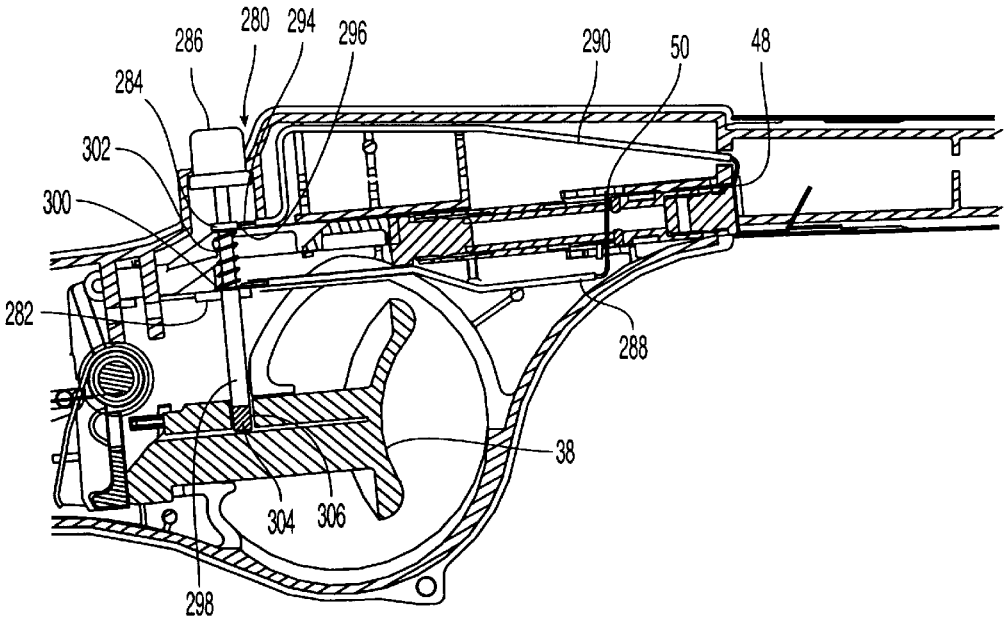
FIG. 10A is a side elevational view of a portion of a utility lighter according to the present invention having another embodiment of the ignition preventing assembly.
Figure 10B:
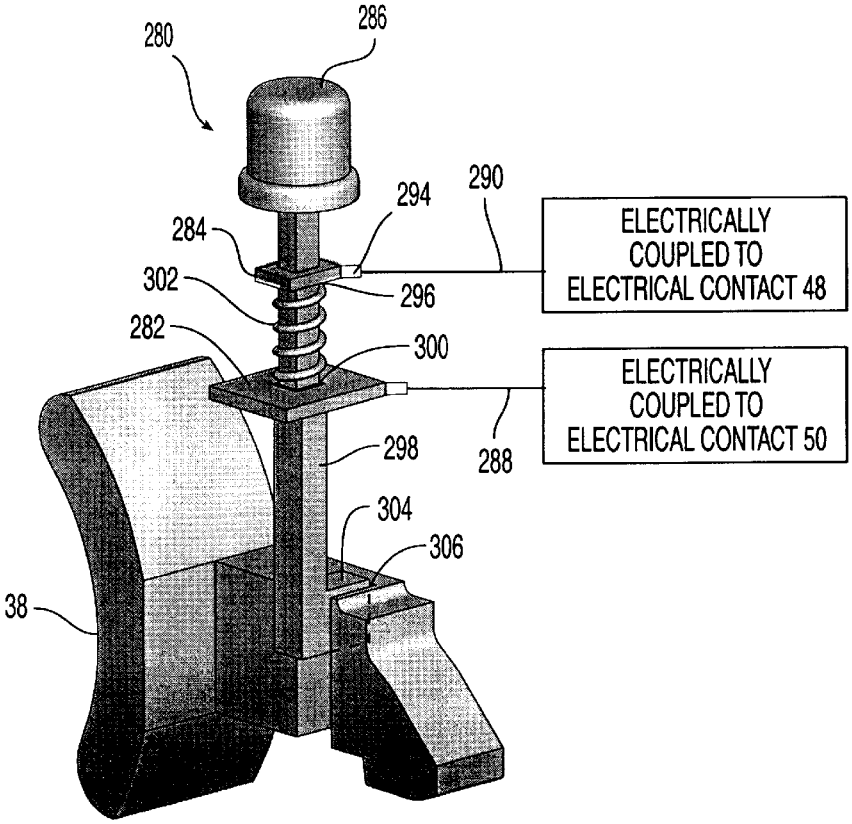
FIG. 10B is a perspective view of the ignition preventing assembly of FIG. 10A.

FIGS. 10A and 10B show yet another embodiment of the ignition preventing mechanism. Ignition prevention mechanism 280 comprises wire 288 connecting an electrically conductive spring 302 to electrical contact 50, and wire 290 connected to electrical contact 48. In this embodiment, the second electrical pathway comprises wire 290, spring 302, and wire 288. Spring 302 is disposed between movable plate 284 and stationary plate 282. Pushbutton 286 is provided for user manipulation, and comprises extension 298 connected to movable plate 284. Extension 298 is dimensioned to be received in central opening 300 on stationary plate 282, and movable with respect to plate 282. When pushbutton 286 is depressed by a user, extension 298 and movable plate 284 are pushed downward through stationary plate 284 and compress spring 302. As spring 302 is being compressed, a second gap 205 is formed in second electrical pathway. As shown in FIG. 10, second gap 205 is defined by third electrode 294 of wire 290 and fourth electrode 296 of spring 302.

When the user releases pushbutton 286, spring 302 biases pushbutton 286 and movable plate 284 upward, and brings fourth electrode 296 into contact with or substantially into contact with third electrode 294 to restore an effective short circuit in the second electrical pathway.

As was the case with other embodiments of the ignition preventing assembly, ignition preventing assembly 280 can be optionally coupled with a mechanical blocking means for resisting unwanted activation. Extension member 298 of button 286 has a blocking leg 304, which engages a cutout 306 in trigger 38 to prohibit movement of trigger 38 when button 286 is not depressed. When button 286 is depressed, extension member 298 slides down and blocking leg 304 no longer engages cutout 306 to allow trigger 38 to be pulled. Preferably, blocking leg 304 continues to engage cutout 306 (and consequently prevent trigger 38 from being pulled) until the gap between third electrode 294 and fourth electrode 296 is sufficiently large to ensure that electrical current generated by activated piezoelectric mechanism 34 travels through the first electrical pathway to create a spark at spark gap 62.

Figure 11A:
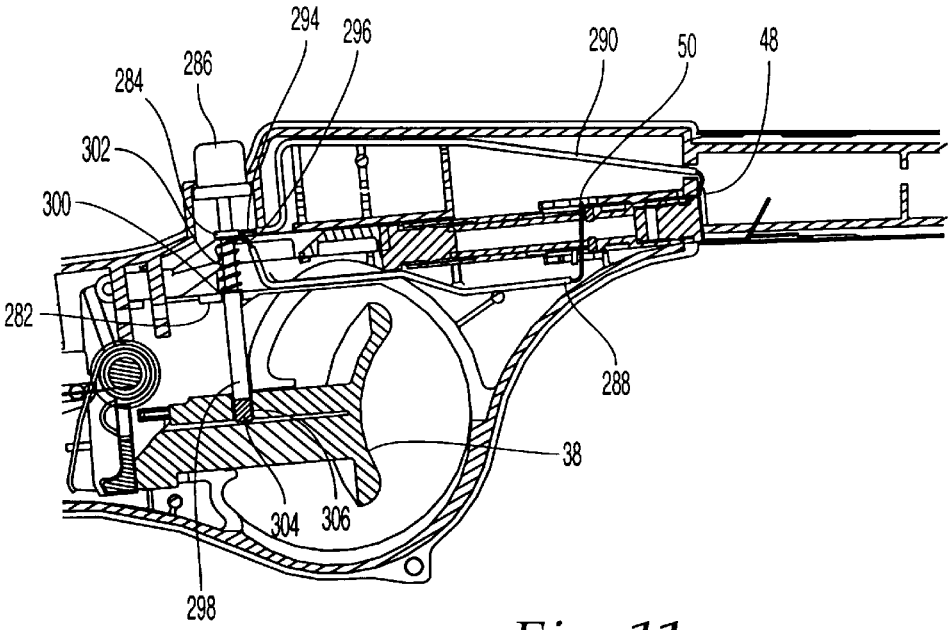
FIG. 11A is a side elevational view of a portion of a utility lighter according to the present invention having another embodiment of the ignition preventing assembly.
Figure 11B:
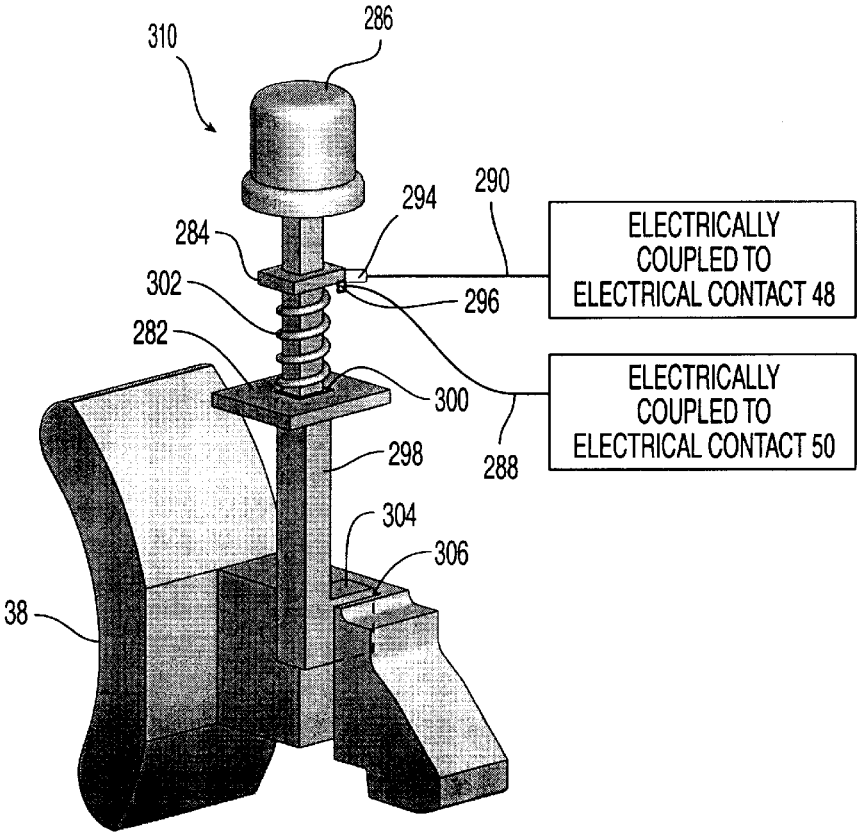
FIG. 11B is a perspective view of the ignition preventing assembly of FIG. 11A.

FIGS. 11A and 11B show another embodiment of the present invention that is substantially similar to ignition preventing assembly 280. Ignition preventing assembly 310 comprises wire 288 connected to electrical contact 50 on piezoelectric mechanism 34 and wire 290 connected to electrical contact 48. Wire 288 is connected to the top of spring 302 or movable plate 284 proximate to wire 290, such that in the normal position, tip 294 of wire 290 and tip 296 of wire 288 are in contact with each other or are close in contact with each other to form an effective short circuit in the second electrical pathway. Depression of pushbutton 286 creates a second gap 205 between third electrode or tip 294 and fourth electrode or tip 296. When button 286 is sufficiently depressed, the second gap 205 will be larger than spark gap 62 so that electrical energy from piezoelectric mechanism 34 will travel through the first electrical pathway to generate a spark at spark gap 62. It is noted that since biasing spring 302 does not form a part of the second electrical path, it may be made from non-metallic material.

Figure 12B:
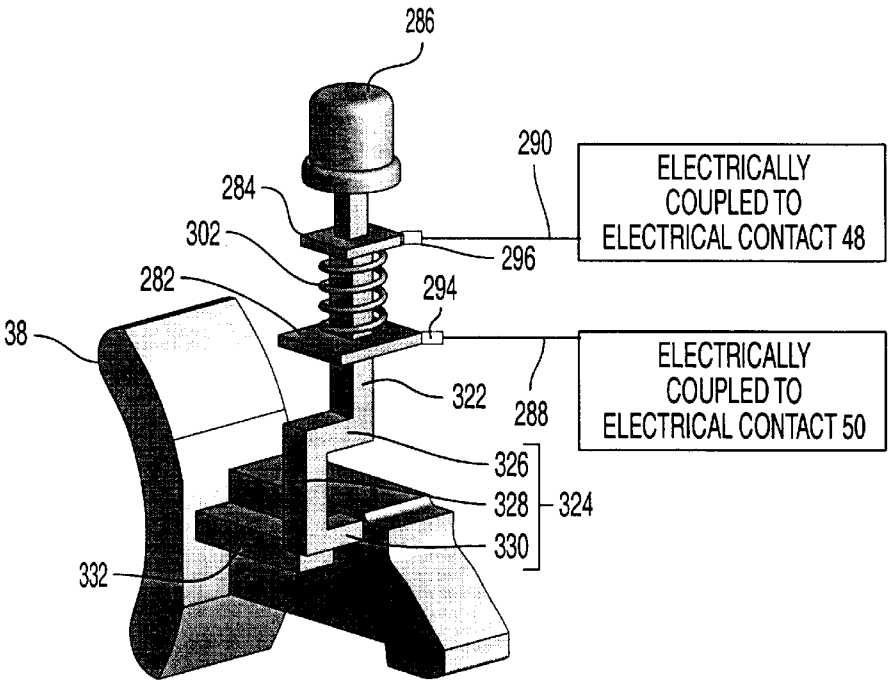
FIG. 12B is a perspective view of the ignition preventing assembly of FIG. 12A.
Figure 12A:
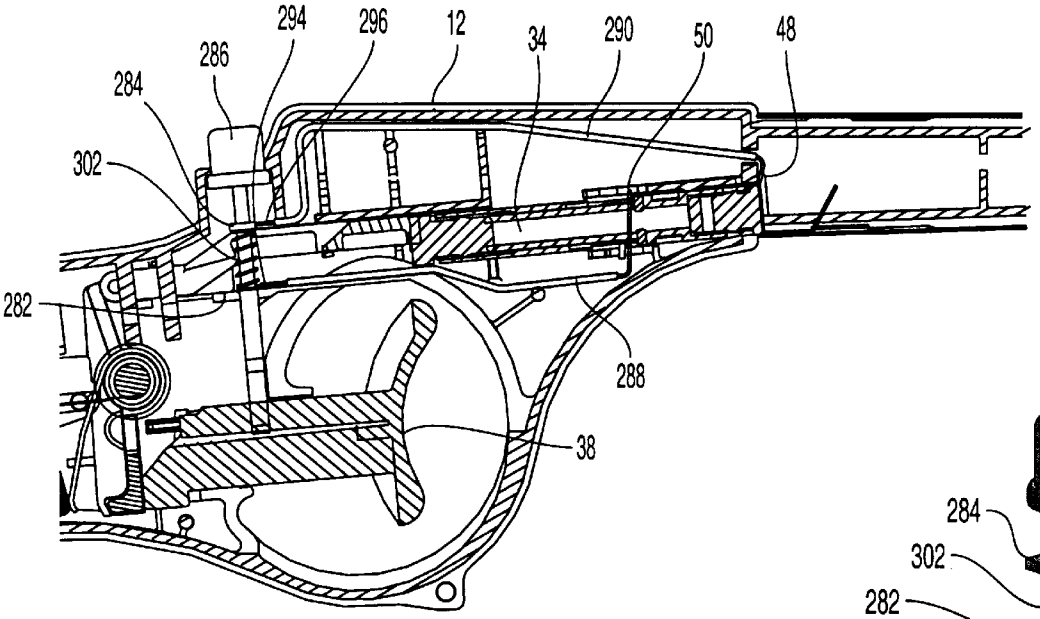
FIG. 12A is a side elevational view of a portion of a utility lighter according to the present invention having another embodiment of the ignition preventing assembly.

FIGS. 12A and 12B show mechanical blocking means for resisting unwanted activation particularly well suited for operation with an ignition preventing assembly that is substantially similar to ignition preventing assembly 280, 310. An extension member 322 of button 286 has a blocking element 324 which prohibits the actuation of trigger 38 only when button 286 is partially depressed as will be described in greater detail below. Blocking element 324 has a first lateral section 326 extending perpendicularly from extension member 322, a middle section 328 extending parallel to extension member 322, and a second lateral section 330 extending from middle section 328 in a direction opposite first lateral section 326. Trigger 38 has a fin 332 that extends partially along the length of trigger 38. The length of middle section 328 is sufficiently large to move pass fin 332.

Blocking element 324 and trigger 38 are arranged so that when button 286 is not depressed, trigger 38 can be pulled without any interference from any part of blocking element 324. However, because third and fourth electrodes 282, 284 are in electrical contact and short circuit piezoelectric mechanism 34 when button 286 is not depressed, no spark is generated in spark gap 62. When button 286 is only partially depressed, second lateral section 330 of blocking element 324 aligns with fin 332 to obstruct movement of fin 332 and prohibit trigger 38 from being pulled. Thus, when button 286 is partially depressed, the activation of lighter 10 is prevented. Because of the length of middle section 328 with respect to the height of trigger 38, trigger 38 can be pulled and freely moves through middle section 328 without any interference from blocking element 324 when button 286 is fully depressed. Thus, normal operation of the lighter is achieved. Preferably, trigger 38 cannot be pulled until the gap between the third and fourth electrodes is larger than spark gap 62.

Figure 13B:
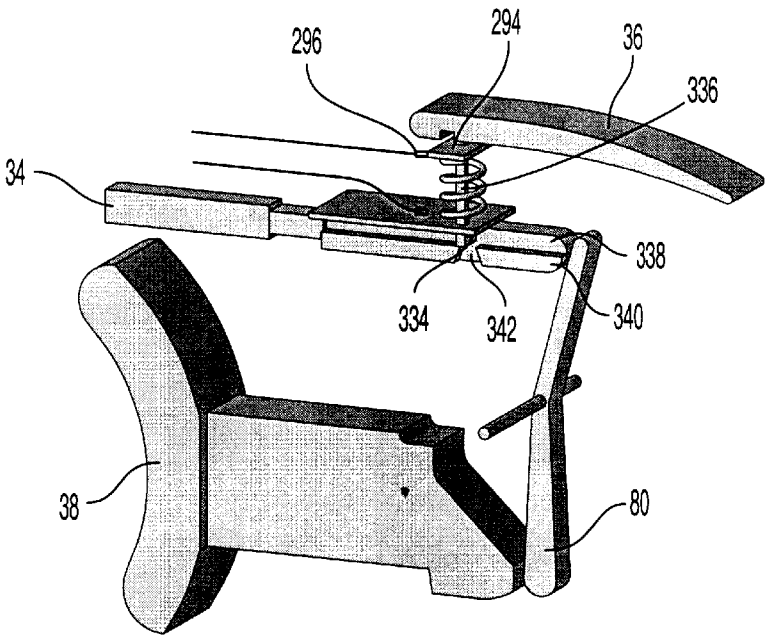
FIG. 13B is a perspective view of the ignition preventing assembly, actuating assembly, and latch member of FIG. 13A.
Figure 13A:
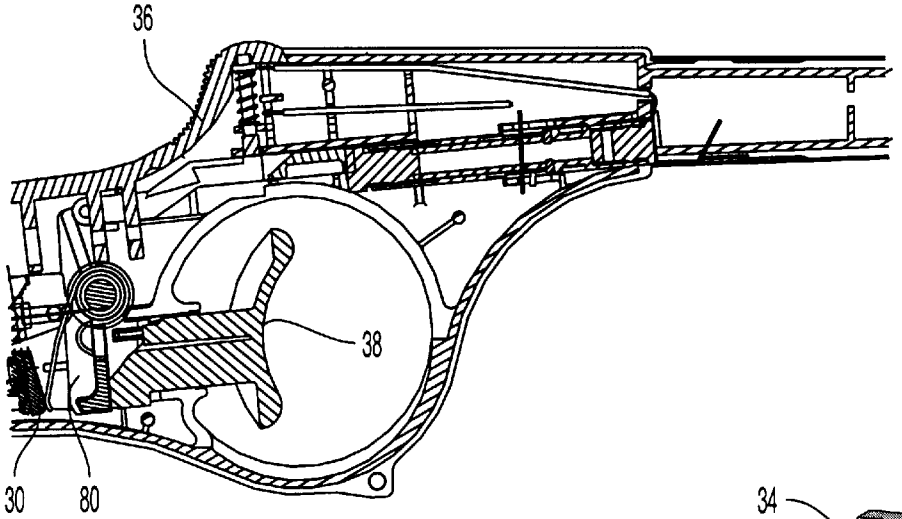
FIG. 13A is a partially fragmented side elevational view depicting another embodiment of the ignition preventing assembly, actuating assembly, and latch member of the present invention.

FIGS. 13A and 13B show another embodiment of a mechanism that prohibits movement of trigger 38 only when latch 36 is partially depressed. When latch 36 is not depressed, a blocking element 334 of an extension member 336 travels within a channel 338 of a linking rod 340. Full movement of trigger 38 is possible because biased pivoting member 80 can rotate as blocking element 334 travels in channel 338. Even though linking rod 340 compresses piezoelectric mechanism 34, the short circuit caused by third and fourth electrodes 294, 296 prevents the generation of a spark in spark gap 62. When latch 36 is partially depressed, blocking element 334 moves down and out of channel 338. Interference between a wall 342 of linking rod 340 and blocking element 334 prohibits movement linking rod 340. Movement of trigger is inhibited because biased pivoting member 80 cannot rotate. When latch 36 is completely depressed, blocking element 334 moves out of engagement with wall 342 and linking rod 340 can move without any interference from blocking element 334. Preferably, blocking element 334 moves out of engagement with wall 342 when the second gap 205 between the third and fourth electrodes is sufficiently larger than spark gap 62, so that the effective resistance of the second electrical pathway is larger than the effective resistance of the first electrical pathway.

Figure 14B:
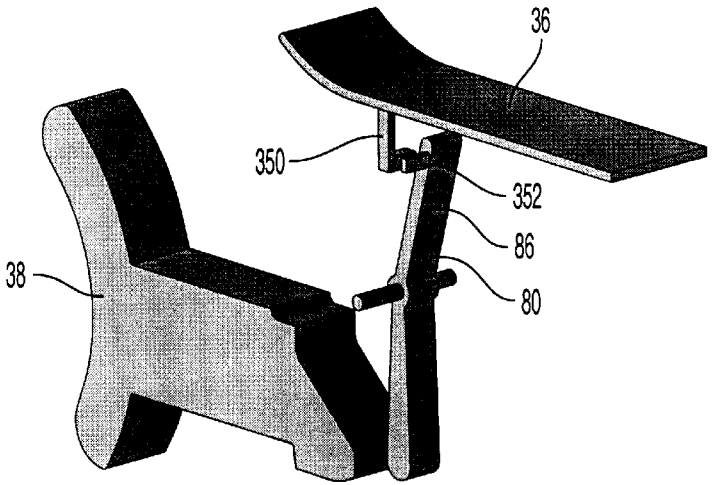
FIG. 14B is a perspective view of the latch member and biased pivoting member of FIG. 14A.
Figure 14A:
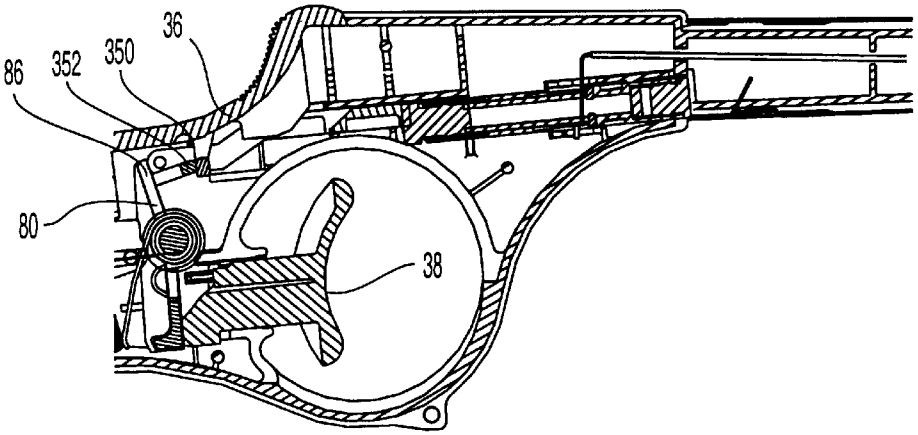
FIG. 14A is a side elevational view of a portion of a utility lighter according to the present invention having another embodiment of the latch member and biased pivoting member.

FIGS. 14A and 14B show another embodiment of latch 36, biased pivoting member 80, and trigger 38. Latch 36 has an L-shaped tab 350 that engages a lateral projection 352 on arm 86 of biased pivoting member 80 when latch 36 is not depressed. The engagement between tab 350 and lateral projection 352 inhibits rotation of biased pivoting member 80, and consequently, movement of trigger 38. As latch 36 is depressed, the downward movement of tab 350 eliminates the alignment between tab 350 and lateral projection 352. As a result, biased pivoting member 80 can rotate when trigger 38 is pulled. Preferably, trigger 38 cannot be pulled until the second gap 205 between the third and fourth electrodes is larger than spark gap 62.

While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

We claim:

1. A lighter comprising:

a housing having a nozzle with an outlet and a fuel supply connected for selective fluid communication with the nozzle;

an electric ignitor having first and second electrical contacts operatively connected to a first electrical pathway, said first electrical pathway comprises a first gap proximate to said outlet;

a second electrical pathway operatively connected to the electric ignitor assembly, said second electrical pathway having an operative configuration and an inoperative configuration, wherein in the inoperative configuration, the resistance of the second electrical pathway is less than the resistance of the first electrical pathway such that electrical current generated by the electric ignitor assembly selectively travels in the second electrical pathway; and wherein in the operative configuration, the resistance of the second electrical pathway is greater than the resistance of the first electrical pathway such that said electrical current selectively travels in the first electrical pathway and jumps across said first gap to form a spark to ignite fuel from the fuel supply.

2. The lighter of claim 1, wherein in the inoperative configuration, the second electrical pathway is a continuous pathway to short circuit the electric ignitor assembly.

3. The lighter of claim 1, wherein the second electrical pathway includes a second gap.

4. The lighter of claim 3, wherein the second gap is larger than the first gap in the operative configuration.

5. The lighter of claim 4, wherein the second gap is at least twice as large as the first gap in the operative configuration.

6. The lighter of claim 1 further comprising an actuating assembly operatively connected to the housing to dispense fuel from the fuel supply and to activate the ignitor assembly.

7. The lighter of claim 6 further comprising a latch member operatively connected to the housing and including a blocking portion connected for biased movement relative to the actuating assembly and normally biased into engagement with the actuating assembly to prevent operative movement thereof, wherein the user may selectively move the blocking portion out of engagement with the actuating assembly to permit operation of the actuating assembly.

8. The lighter of claim 7 wherein the latch member is a pushbutton or a slide member.

9. The lighter of claim 1 further comprising a button wherein selective movement of said button creates a second gap in the second electrical pathway to change the resistance of the second electrical pathway.

10. The lighter of claim 9, wherein said button is a latch member which is pivotable by a user to create the second gap.

11. The lighter of claim 9, wherein said button is a slider which is slidable by a user to create the second gap.

12. The lighter of claim 9, wherein said button is a pushbutton which is depressible by a user to create the second gap.

13. A lighter comprising:

a housing having a nozzle with an outlet and a fuel supply connected for selective fluid communication with the nozzle;

an electric ignitor releasing electrical energy upon activation and having a first electrical pathway with first and second electrodes, the flow of the electrical current through said first electrical pathway generating a spark between the first and second electrodes proximate the nozzle outlet;

an actuating assembly operatively connected to the housing to dispense fuel from the fuel supply and to activate the ignitor assembly; and an ignition preventing assembly electrically coupled to the ignitor assembly for preventing the generation of a spark at the nozzle outlet, the ignition preventing assembly having:

a second electrical pathway for the released electrical energy; and a switching member moveable between a first position in which the electrical current flows through the first electrical pathway and a second position in which the electrical current flows through the second electrical pathway, wherein the switching member is normally biased in the second position and a user may selectively move the switching member into the first position to permit generation of the spark at the nozzle outlet.

14. The lighter of claim 13, wherein the electric ignitor assembly includes a piezoelectric mechanism and the housing includes an electrically conductive wand in direct contact with an electrical contact on the piezoelectric mechanism.

15. The lighter of claim 14, wherein the nozzle is formed from electrically conductive material and is electrically connected to the piezoelectric mechanism to form the second electrode such that a spark gap is formed between the nozzle and the electrically conductive wand.

16. The lighter of claim 15, wherein the electrically conductive wand includes a tab extending toward the nozzle and the spark gap is formed between the tab and the nozzle.

17. The lighter of claim 16, further including an electrically insulating cap disposed around at least a portion of the nozzle for preventing undesired sparks between the nozzle and the electrically conductive wand.

18. The lighter of claim 13, wherein the second electrical pathway includes third and fourth electrodes.

19. The lighter of claim 18, wherein the third electrode is attached to the housing and is electrically connected to the piezoelectric mechanism.

20. The lighter of claim 19, wherein the electrical connection between the third electrode and the piezoelectric mechanism is through the electrically conductive wand.

21. The lighter of claim 19, wherein the fourth electrode is attached to the switching member and electrically connected to the piezoelectric mechanism.

22. The lighter of claim 21, wherein the third and fourth electrodes are in contact when the switching member is in the second position.

23. The lighter of claim 18, wherein the second electrical pathway includes a second gap between the third and fourth electrodes of variable size.

24. The lighter of claim 23, wherein the second gap is larger than the spark gap when the switching member is in the first position.

25. The lighter of claim 24, wherein the second gap is at least approximately twice as large as the spark gap when the switching member is in the first position.

26. The lighter of claim 13, wherein the switching member further includes a blocking portion connected for biased movement relative to the actuating assembly and normally biased into engagement with the actuating assembly to prevent operative movement thereof, wherein the user may selectively move the blocking portion out of engagement with the actuating assembly to permit operation of the actuating assembly.

27. The lighter of claim 26, wherein the actuating assembly includes a trigger extending from the handle and operating to actuate the ignitor assembly when pulled in a first direction.

28. The lighter of claim 27, wherein the blocking portion engages a cutout of the trigger to prevent operative movement thereof.

29. The lighter of claim 27, wherein the actuating assembly further includes a biased pivoting member connected between the trigger and a linking rod, the linking rod being operatively connected to the electric ignitor assembly for activating the electric ignitor assembly when a user pulls the trigger.

30. The lighter of claim 29, wherein the blocking portion of the switching member includes a hooked tab normally biased to engage a stop member structure on the linking rod to prevent operative movement relative to the electric ignitor assembly.

31. The lighter of claim 27, wherein the switching member further comprises a resilient tab extending from the switching member and the housing includes a hook configured and dimensioned to engage the tab when the switching member is in the first position.

32. The lighter of claim 31, wherein the trigger further includes a shoulder configured and dimensioned to disengage the tab from the hook and engage the tab when the trigger is pulled.

33. The lighter of claim 32, wherein the shoulder engages the tab more proximate to the switching member than the hook engages the tab to prevent re-engagement of the tab and hook when the trigger is released.

34. The lighter of claim 13, wherein the switching member further includes a blocking portion connected for biased movement relative to the actuating assembly and normally biased out of engagement with the actuating assembly to permit operative movement thereof, wherein the blocking portion engages the actuating assembly only when the switching member is between the first and second positions.

35. The lighter of claim 13, wherein the switching member is a pushbutton and the second electrical pathway includes a resilient member operatively associated with the pushbutton such that moving the pushbutton to the first position compresses the resilient member.

36. The lighter of claim 35, wherein the resilient member is made of an electrically conductive material.

37. The lighter of claim 35, wherein compression of the resilient member forms a second gap, said second gap larger than the spark gap when the pushbutton is in the first position.

38. A lighter comprising:

a housing having a nozzle with an outlet;

an electric ignitor having first and second electrical contacts operatively connected to a first electrical pathway, said first electrical pathway comprises a first gap proximate to said outlet;

a second electrical pathway operatively connected to the electric ignitor assembly, said second electrical pathway having an operative configuration and an inoperative configuration, wherein in the inoperative configuration, the resistance of the second electrical pathway is less than the resistance of the first electrical pathway such that electrical current generated by the electric ignitor assembly selectively travels in the second electrical pathway; and wherein in the operative configuration, the resistance of the second electrical pathway is greater than the resistance of the first electrical pathway such that said electrical current selectively travels in the first electrical pathway and jumps across said first gap to form a spark to ignite fuel from a fuel supply.

* * * * *